US007911462B2

(12) United States Patent
Lin

(10) Patent No.: US 7,911,462 B2
(45) Date of Patent: Mar. 22, 2011

(54) SOFT-START HIGH DRIVING METHOD AND SOURCE DRIVER DEVICE

(75) Inventor: Che-Li Lin, Taipei (TW)

(73) Assignee: Novatek Microelectronics Corp., Hsinchu (TW)

( * ) Notice: Subject to any disclaimer, the term of this patent is extended or adjusted under 35 U.S.C. 154(b) by 1108 days.

(21) Appl. No.: 11/161,081

(22) Filed: Jul. 22, 2005

(65) Prior Publication Data

US 2006/0238478 A1 Oct. 26, 2006

(30) Foreign Application Priority Data

Apr. 21, 2005 (TW) ..... 94112666 A

(51) Int. Cl.
*G09G 3/36* (2006.01)

(52) U.S. Cl. ..... 345/212; 345/99

(58) Field of Classification Search ..... 345/211–213, 345/208, 204, 99–100; 377/30
See application file for complete search history.

(56) References Cited

U.S. PATENT DOCUMENTS

| | | | | |
|---|---|---|---|---|
| 6,172,516 | B1 * | 1/2001 | Han et al. | 326/27 |
| 6,313,611 | B1 * | 11/2001 | Mowry et al. | 320/136 |
| 6,337,545 | B1 * | 1/2002 | Kwon | 315/408 |
| 7,317,440 | B2 * | 1/2008 | Chung | 345/89 |
| 2003/0043129 | A1 * | 3/2003 | Tazuke | 345/204 |
| 2004/0056833 | A1 * | 3/2004 | Kitagawa et al. | 345/92 |
| 2004/0160270 | A1 * | 8/2004 | Tzeng et al. | 330/10 |
| 2004/0233226 | A1 * | 11/2004 | Toriumi et al. | 345/690 |

* cited by examiner

*Primary Examiner* — Chanh Nguyen
*Assistant Examiner* — Allison Walthall
(74) *Attorney, Agent, or Firm* — Jianq Chyun IP Office

(57) ABSTRACT

A soft-start high driving method and device to drive display panels are provided. The driving method includes the following steps. First, a display signal is provided for driving a display panel and displaying images. If no predetermined event happens, then, a high-driving mode is used for dynamically adjusting the driving capacity of the display signal. Finally, if a predetermined event happens, the soft-start high-driving mode is performed to dynamically adjust the driving capacity of the display signal.

22 Claims, 10 Drawing Sheets

SOFT-START HIGH DRIVING METHOD AND SOURCE DRIVER DEVICE

CROSS-REFERENCE TO RELATED APPLICATION

This application claims the priority benefit of Taiwan application serial no. 94112666, filed on Apr. 21, 2005. All disclosure of the Taiwan application is incorporated herein by reference.

BACKGROUND OF THE INVENTION

1. Field of Invention

The present invention relates to a method and a device for driving display panels, and particularly to a soft-start driving method and a source driver device.

2. Description of the Related Art

Currently, display devices are applied in various electronic products, such as automatic teller machines (ATMs), personal computers (PCs), mobile telephones and television sets. Through a display device, a user is able to monitor the status of an electronic product, or get important information. Various kinds of displays are manufactured nowadays using different technologies and principles, and each of them has unique performances and specific applicable fields. Overall, displays can be categorized in flat panel displays (FPD) and cathode ray tube (CRT) displays. Wherein, the FPD has gradually replaced the traditional CRT displays. Flat panel displays include liquid crystal displays (LCDs), plasma display panels (PDP), organic light emitting displays (OLEDs), and field emission displays (FEDs). Most of the various FPDs use a plurality of scan signals (gate signals) along with a data signal (source signal) for panels to display images.

In the example of a LCD, following a trend of large-scale panels and an increased resolution, the driving device load for driving a display panel is increased with a reduced charge-discharge time. Thus, a sufficient driving capability of output signals from a driving device must be incorporated in the driving device design to meet the large-scale panel and the increased resolution requirement. During a charge-discharge process of each pixel of a panel, however, a large driving capability is only required at signal transitions to speed up the charge-discharge processes. After completing a charge-discharge process with a pixel, a large driving capability of signals would be a waste.

SUMMARY OF THE INVENTION

An object of the present invention is to provide a soft-start high driving method, using a soft-start high-driving mode, to dynamically adjust the driving capacity of a display signal.

Another object of the present invention is to provide a soft-start high driving device to dynamically adjust the driving capacity of display signals. Further, as a predetermined event happens, a soft-start process starts to dynamically adjust the driving capacity of the display signal.

To achieve the above and the other objects, the present invention provides a soft-start high driving method to drive a display panel. The driving method includes the following steps. First, a display signal is provided for driving a display panel and displaying an image on a screen. Further, if no predetermined event happens, a high-driving mode is used for dynamically adjusting the driving capacity of a display signal. Moreover, if a predetermined event happens, a soft-start high-driving mode is used for dynamically adjusting the driving capacity of a display signal.

According to the soft-start high driving method in an embodiment of the present invention, the above-mentioned predetermined event includes, for example, one of turning-on, turning-off, an abnormal clock signal, an abnormal control signal, insufficient electric power, and excessive electric power. The abnormal clock signal hereinabove includes, for example, suspended transitions of clock signal. The abnormal control signal hereinabove includes situations such as, the time-interval of transition of a latching signal is shorter than a minimum latching period, the time-interval of transition of a latching signal is longer than a maximum latching period, or a latching signal transition is suspended.

According to the soft-start high driving method in an embodiment of the present invention, a high-driving mode for dynamically adjusting the driving capacity of a display signal includes the following steps. First, as a display signal switches the status, the driving capacity of the display signal is increased to a preset high-driving amount. Then, as the time for a display signal to increase the driving capacity reaches a preset high-driving time, the driving capacity of the display signal declines back to an original amount.

According to the soft-start high driving method in an embodiment of the present invention, the steps of performing a soft-start high-driving mode include that during a soft-start adjustment, the preset high-driving amount is gradually increased from an original amount to a maximum preset amount, or gradually decreased from the maximum preset amount to the original amount.

According to the soft-start high driving method in an embodiment of the present invention, the steps of the soft-start high-driving mode include that during a soft-start adjustment, the preset high-driving time is gradually increased from a minimum high-driving time to a maximum high-driving time, or gradually decreased from the maximum high-driving time to the minimum high-driving time.

On the other hand, the present invention provides a soft-start high driving device to drive a display panel. The driving device includes a timing controller and a source driver. According to the timing of a clock signal, the timing controller outputs a latching signal and display data. The source driver is coupled to the timing controller and the display panel for receiving the latching signal and the display data and outputting a display signal to the display panel. Wherein, if no predetermined event happens, a high-driving mode is used for dynamically adjusting the driving capacity of a display signal. In addition, if a predetermined event happens, a soft-start high-driving mode is used for dynamically adjusting the driving capacity of a display signal.

According to the soft-start high driving device in an embodiment of the present invention, the above-mentioned source driver includes a data-latching device, a digital-to-analog converter (DAC), an output buffer, and a high-driving control unit. The data-latching device latches and outputs the display data according to a latching signal. The DAC converts the display data output from the data-latching device into a display signal. The output buffer is coupled to the DAC for dynamically adjusting the driving capacity of the display signal according to a high-driving control signal to output the display signal to the display panel. As the display signal switches its status, the high-driving control unit outputs the high-driving control signal for controlling the output buffer, so that the driving capacity of the display signal is increased to a preset high-driving amount. Once the time for increasing the driving capacity of the display signal reaches a preset high-driving time, the output buffer makes the driving capacity of the display signal decline to an original amount.

According to the soft-start high driving device in an embodiment of the present invention, during a soft-start adjustment period, the above-mentioned high-driving control unit controls the output buffer through the high-driving control signal to gradually increase the preset high-driving amount from an original amount to a maximum preset amount, or gradually decrease it from the maximum preset amount to the original amount.

According to the soft-start high driving device in an embodiment of the present invention, during a soft-start adjustment period, the above-mentioned high-driving control unit controls the output buffer through the high-driving control signal for gradually increasing the preset high-driving time from a minimum high-driving time to a maximum high-driving time, or gradually decreasing it from the maximum high-driving time to the minimum high-driving time.

The high-driving mode for driving a display panel of the present invention is applied at transitions of a display signal to increase the driving capacity thereof, then the driving capacity is pulled down to an original amount. Therefore, the present invention is able to effectively reduce power consumption and maintain, even shorten the output settling time. Meanwhile, by means of a soft-start high-driving mode in the present invention, a surging current caused by turning on/turning off or other specific conditions can be prevented, which further makes the source driver immune to incorrect timing sequence. In addition, the soft-start high-driving mode also reduces a potential burning risk with external system components (for example, inductors) and improves the safety and the reliability of the whole display system.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve for explaining the principles of the invention.

DESCRIPTION OF THE EMBODIMENTS

For a simple description, a liquid crystal display (LCD) is taken as an example in the embodiments of the present invention hereinafter. Anyone skilled in the art may apply the present invention to other kinds of display devices without departing from the scope or spirit of the invention.

Figure 1A:
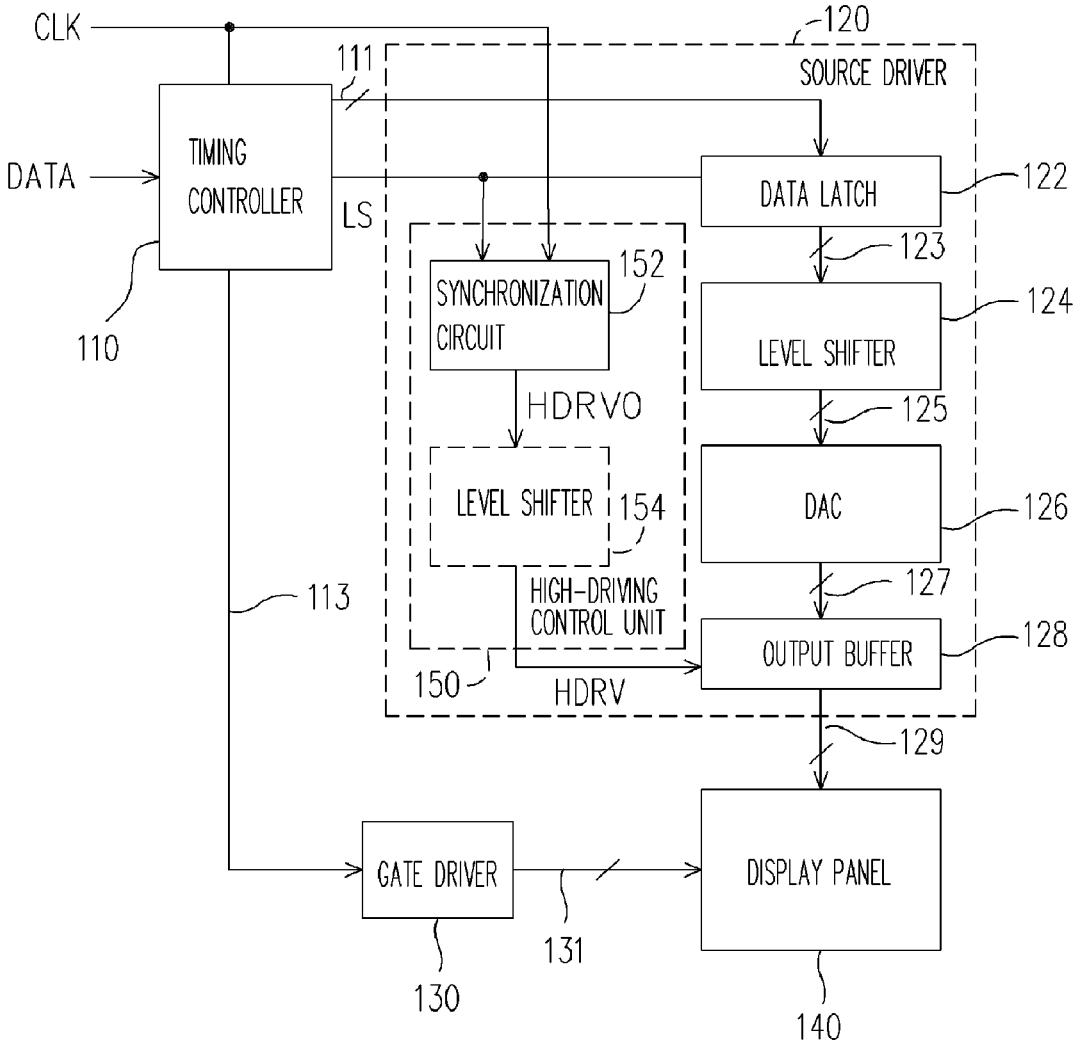
FIG. 1A is a schematic block diagram showing a display device equipped with a soft-start high driving device according to an embodiment of the present invention.

FIG. 1A is a schematic block diagram showing a display device equipped with a soft-start high driving device according to an embodiment of the present invention. Referring to FIG. 1A, the display device includes a timing controller 110, a source driver 120, a gate driver 130 and a display panel 140 (for example, a LCD). The timing controller 110 receives display data DATA, and outputs a latching signal LS and display data 111 according to the timing of a clock signal CLK. The source driver 120 receives the latching signal LS and the display data 111, and outputs a display signal 129 to the display panel 140. The timing controller 110 further outputs a scan control signal 113 to the gate driver 130. The gate driver 130 outputs a scan signal 131 to the display panel 140 according to the scan control signal 113. Following the timing of the scan signal 131, the display panel 140 displays the received display signal 120 on the screen.

Following the trend of a large-scale panel and an increased resolution of display panels, the source driver 120 is faced with an increased load to reduce a charge-discharge time when driving the display panel 140. Therefore, the driving capacity of the signal output from the source driver 120 must be advanced. On the other hand, the driving capacity of the source driver 120 should not be too large so as to save the power. Based on the above-described consideration, the source driver 120 in FIG. 1A uses a high-driving mode to dynamically adjust the driving capacity of the display signal 129. The source driver 120 includes a data-latching device 122, a level shifter 124, a digital-to-analog converter (DAC) 126, an output buffer 128 and a high-driving control unit 150. The data-latching device 122 latches the display data 111 and outputs the latched display data 123 according to the timing of the latching signal LS. The level shifter 124 converts the level of the display data 123 into a level acceptable by the DAC 126. The DAC 126 converts a display data 125, which is output from the data-latching device 122 and then converted by the level shifter 124, into an analog display signal 127. The output buffer 128 dynamically adjusts the driving capacity of the display signal 129 and outputs the adjusted display signal 129 to the display panel 140 according to a high-driving control signal HDRV.

Figure 1B:
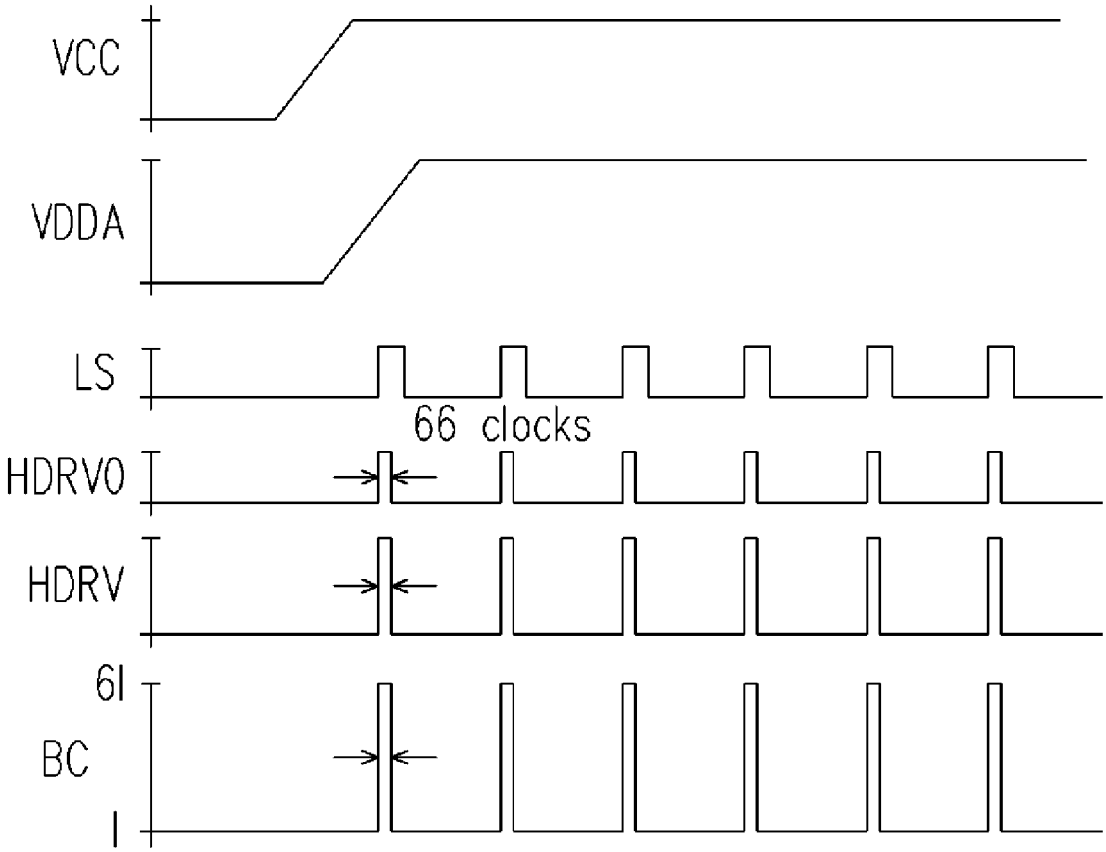
FIG. 1B is a schematic timing chart of the signals in FIG. 1A.

As the display signal 129 switches status (for example, inverting polarity), the high-driving control unit 150 outputs a high-driving control signal HDRV to make the output buffer 128 increase the driving capacity of the display signal 129 to a preset high-driving amount. Quite often, however, prior to the transition of the display signal 129, a latching signal LS is generated to latch new display data. In the embodiment, the high-driving control unit 150 accordingly sends out the high-driving control signal HDRV following the timing of the latching signal LS. FIG.1B is a schematic timing chart of the signals in FIG. 1A. Referring to FIGS. 1A and 1B, a synchronization circuit 152 in the high-driving control unit 150 sends out a high-driving control signal HDRV0 following the timing of the latching signal LS. The level shifter 154 converts the level of the high-driving control signal HDRV0 into a level acceptable by the output buffer 128, and outputs the high-driving control signal HDRV. Anyone skilled in the art is able to match an output level from the synchronization circuit 152 with the output buffer 128, so that the level shifter 154 can be spared.

After receiving the high-driving control signal HDRV, the output buffer 128 would decide a bias current BC of an internal operational amplifier and further change the output driving capacity thereof. For example, the original current of the bias current BC of the operational amplifier inside the output buffer 128 is I, and the output driving capacity of the buffer 128 is an original amount. As the high-driving control signal HDRV takes a high level, the current of the bias current BC is increased to 6 I, and further the output driving capacity of the output buffer 128 is increased to a preset high-driving amount, for example, six times of the original amount. Meanwhile, as the time for increasing the driving capacity of the display signal 129 reaches a preset high-driving time (for example, after the synchronization circuit 152 counts 66 clocking pulses of the clock signal CLK), the synchronization circuit 152 would pull down the high-driving control signal HDRV/HDRV0 to a low level. Thus, the bias current BC of the operational amplifier inside the output buffer 128 goes back to the original current I. Consequently, the driving capacity of the display signal 129 also goes back to the original amount by controlling the output buffer 128. Anyone skilled in the art is able to take advantage of a RC charge-discharge circuit (resistance-capacitance circuit) or other electronic layouts to control the time for increasing the signal driving capacity through the synchronization circuit 152.

Accordingly, when driving the display panel 140, if a pixel capacitor needs to be charged and discharged for signal transitions, the output driving capacity of the output buffer 128 is dynamically advanced to speed up the charge-discharge process. After the pixel is finished with charge-discharge, the driving capacity of the display signal 129 is adjusted back to the original amount. In this way, the power can be saved.

Figure 1C:
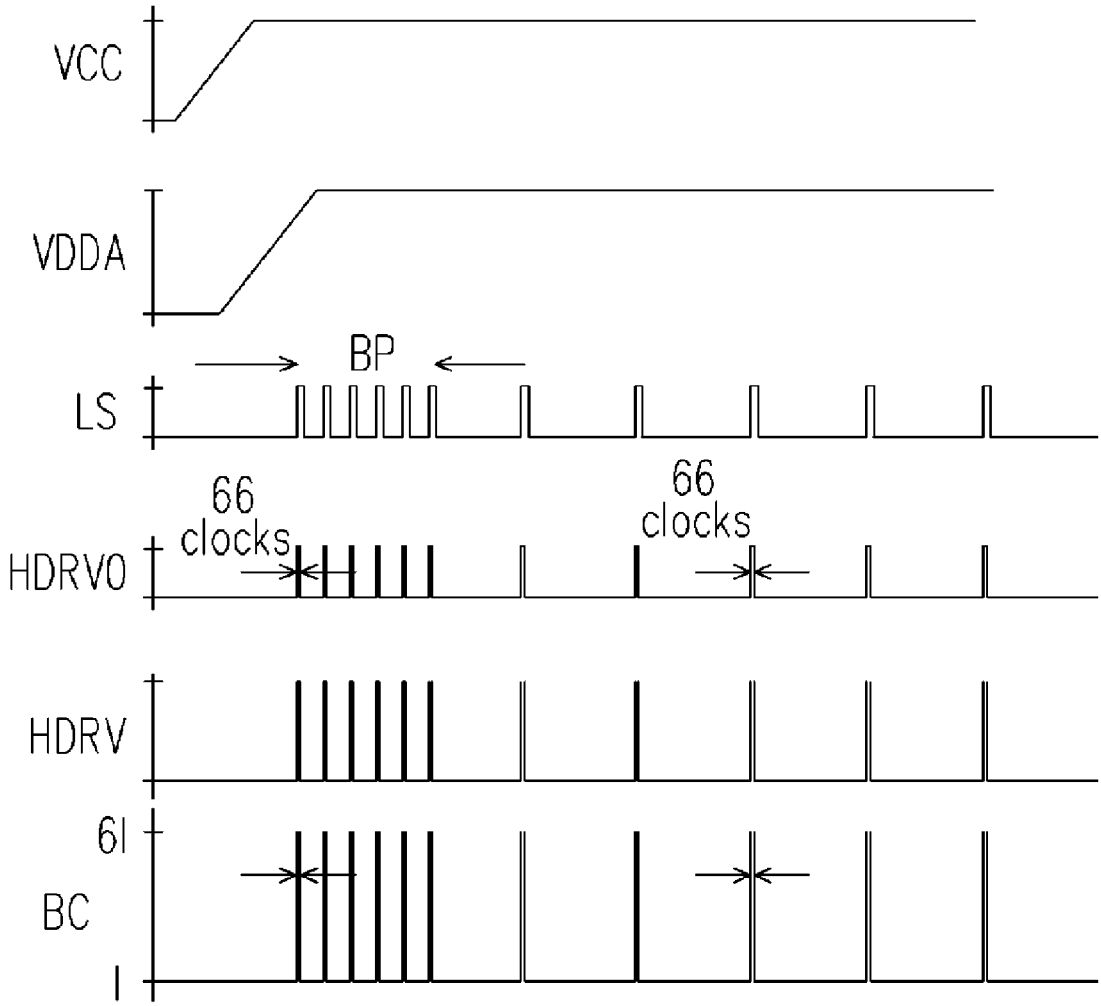
FIG. 1C is a schematic timing chart of an erroneous latching signal produced by the timing controller in FIG. 1A.

When a predetermined event happens (including one of turning-on, turning-off, an abnormal clock signal, an abnormal control signal, insufficient power, and excessive power), the above-described high-driving mode would erroneously generate an excessive surging current. At turning-on, for example, the timing controller 110 would probably send out an erroneous latching signal LS. FIG. 1C is a schematic timing chart of an erroneous latching signal LS produced by the timing controller 110 at turning-on in FIG. 1A. Referring to FIGS. 1A and 1C, at turning-on, the required digital power voltage VCC and analog power voltage VDAA are applied. During an initial turning-on period BP, the timing controller 110 probably sends out, for example, an erroneous latching signal LS with dense timing pulses, which makes the source driver 120 output an excessive current at turning-on and results in excessive current over the whole initial turning-on period BP. To prevent the erroneous actions of the source driver, a new mechanism must be designed.

Figure 2:
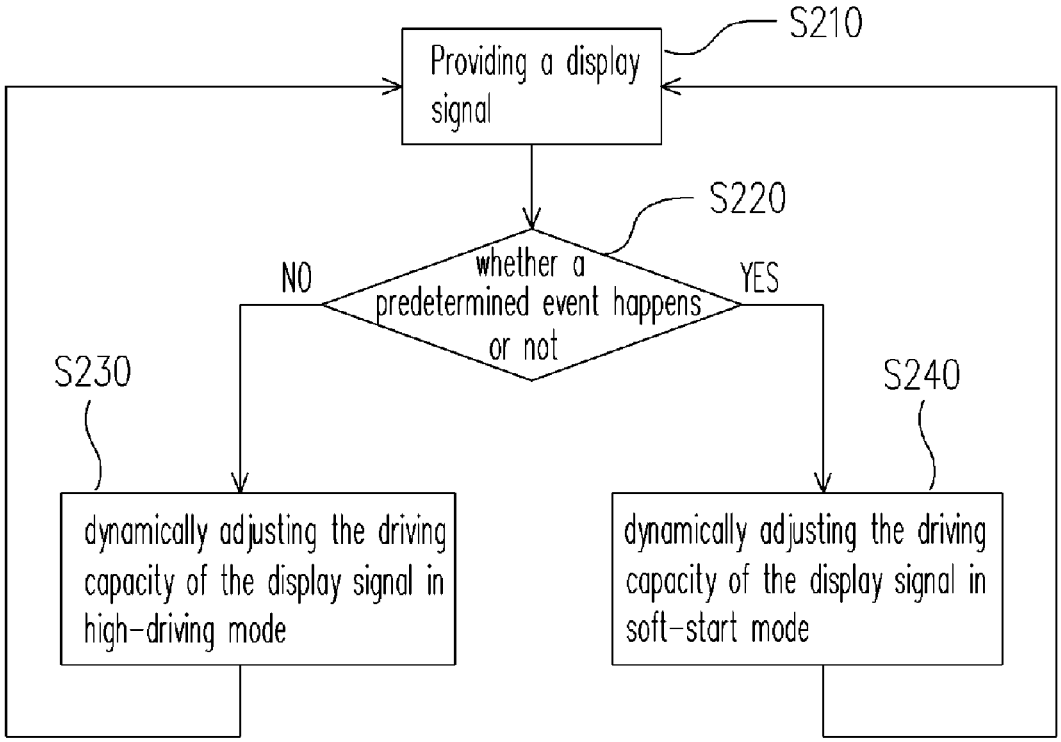
FIG. 2 is a flowchart of a soft-start high driving method according to an embodiment of the present invention.

FIG. 2 is a flowchart of a soft-start high driving method according to an embodiment of the present invention. Referring to FIG. 2, first at the step S210, a display signal is provided for driving a display panel to display a corresponding frame. At the step S220, it is decided whether a predetermined event happens or not, for example, turning-on, turning-off, an abnormal clock signal, an abnormal control signal, insufficient power, and excessive power. If no predetermined event happens, the process goes to the step S230 for dynamically adjusting the driving capacity of the display signal in high-driving mode. Otherwise, if a predetermined event happens, the process goes to the step S240 for dynamically adjusting the driving capacity of the display signal in soft-start high-driving mode for the above-described high-driving process.

The step S230 includes the following steps. When a display signal switches status, the driving capacity of the display signal is increased to a preset high-driving amount. Then, when the time for increasing the driving capacity of the display signal reaches a preset high-driving time, the driving capacity of the display signal is returns to an original amount.

Figure 3A:
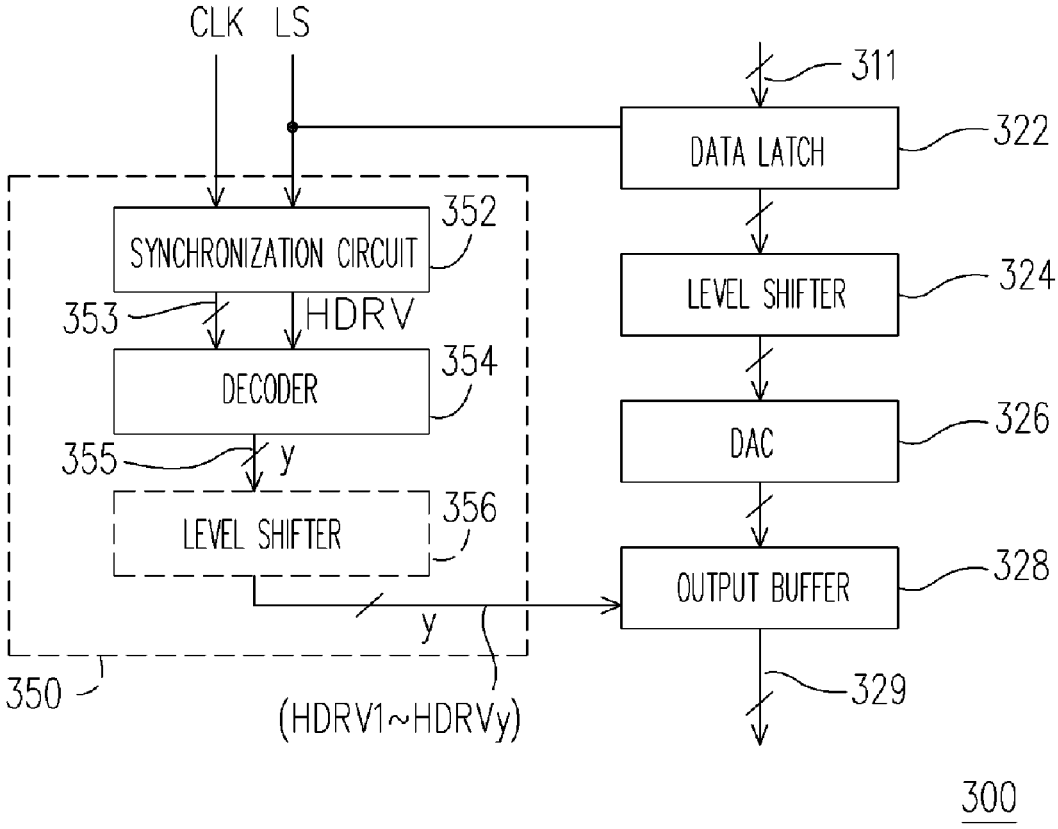
FIG. 3A is a schematic block diagram showing a soft-start high driving device according to an embodiment of the present invention.

FIG. 3A is a schematic block diagram showing a soft-start high driving device according to an embodiment of the present invention. Referring to FIG. 3A, a source driver 300, similar to the source driver 120 in FIG. 1A, includes a data-latching device 322, a level shifter 324, a digital-to-analog converter (DAC) 326, an output buffer 328 and a high-driving control unit 350. Wherein, the high-driving control unit 350 includes a synchronization circuit 352, a decoder 354 and a level shifter 356.

Figure 3B:
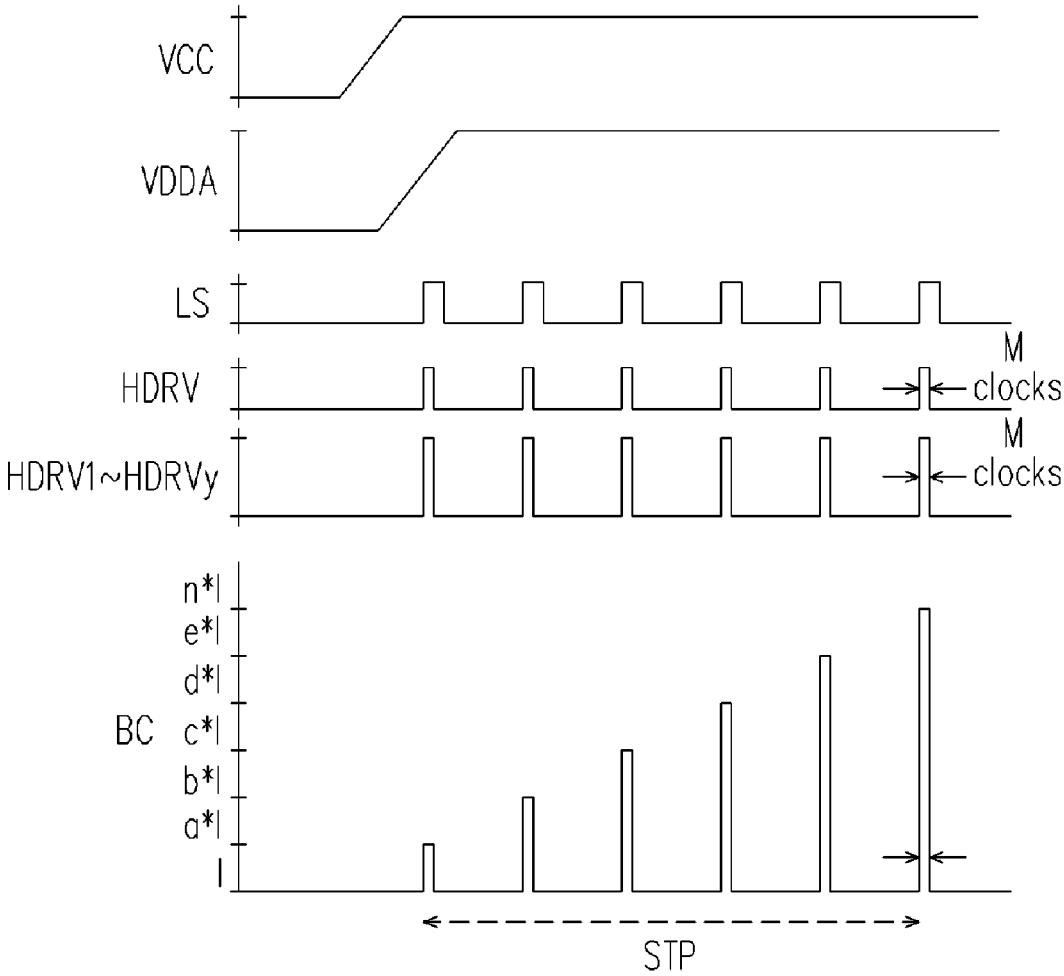
FIG. 3B is a schematic timing chart of the signals in FIG. 3A when the power voltage returns to a normal level.

FIG. 3B is a schematic timing chart of the signals in FIG. 3A when the power voltage returns to a normal level (for example, turning-on or resuming from a standby status). Referring to FIG. 3A and 3B, the data-latching device 322 receives a display data 311 output from a timing controller (not shown) and latches the display data according to the timing of a latching signal LS. The synchronization circuit 352 receives the latching signal LS and a clock signal CLK, and outputs an internal control signal 353 and a high-driving control signal HDRV. The high-driving control signal HDRV decides whether the decoder 354 is enabled or not. When the power voltage is restored back from a low level to a normal level, the process enters a soft-start adjusting period STP. During the STP, the synchronization circuit 352 gradually, from a small amount to a large amount, adjusts the internal control signal 353 output therefrom. The decoder 354 decodes the internal control signal 353 and outputs y pieces of high-driving control signals 355 according to the decoded signal 353. Wherein, y pieces of high-driving control signals 355 correspond to the control signals required by a bias switch inside the output buffer 328. The level shifter 356 converts the level of the high-driving control signal 355 into a level acceptable by the output buffer 328, and outputs high-driving control signals HDRV1-HDRVy. Anyone skilled in the art is able to match the output level of the decoder 354 with the output buffer 328. In this way, the level shifter 356 can be spared.

According to the received high-driving control signals HDRV1-HDRVy, the output buffer 328 decides a bias current BC of an operational amplifier inside the buffer and further changes the driving capacity of the output signal 329 thereof. As the time for increasing the driving capacity of the display signal 329 reaches a preset high-driving time (for example, after the synchronization circuit 352 counts M clocking pulses of the clock signal CLK), the synchronization circuit 352 would pull the high-driving control signal HDRV to a low level. At the point, the decoder 354 is disabled and the bias current BC of the operational amplifier inside the output buffer 328 returns to an original current I. Thus, the driving capacity of the display signal 329 can be restored back to the original amount by controlling the output buffer 328. Anyone skilled in the art is able to take advantage of a RC charge-discharge circuit (resistance-capacitance circuit) or other electronic layouts to control the time for increasing the signal driving capacity through the synchronization circuit 352.

The original current of the bias current BC of the operational amplifier inside the output buffer 328 is I. During the preset high-driving time, the bias switch inside the buffer is controlled according to the high-driving control signals HDRV1-HDRVy. In this way, the current amount of the bias current BC is gradually increased to n*I during the soft-start adjusting period STP and the output driving capacity of the output buffer 328 is accordingly increased to a n times of the original amounts. In the soft-start adjusting process in the embodiment, the bias current BC is set in six-step soft-start for the preset high-driving time (as shown in FIG. 3B, the current amount of the bias current BC is gradually adjusted in six steps from I, a*I, b*I, c*I, a*I, e*I to n*I). Anyone skilled in the art is able to specify other stage number to meet the requirement. In addition, the method to adjust the driving capacity is not limited to the above-described gradually increasing manner. However, anyone skilled in the art is able to take a gradually decreasing manner or other soft-start manner to adjust the driving capacity depending on various predetermined events (for example, turning-on, turning-off, an abnormal clock signal, an abnormal control signal, insufficient power, and excessive power). For example, during a soft-start adjusting period STP, the preset high-driving amount is gradually increased from an original amount to a maximum preset amount. Alternatively, during a soft-start adjusting period STP, the preset high-driving amount is gradually decreased from a maximum preset amount to an original amount.

Figure 4A:
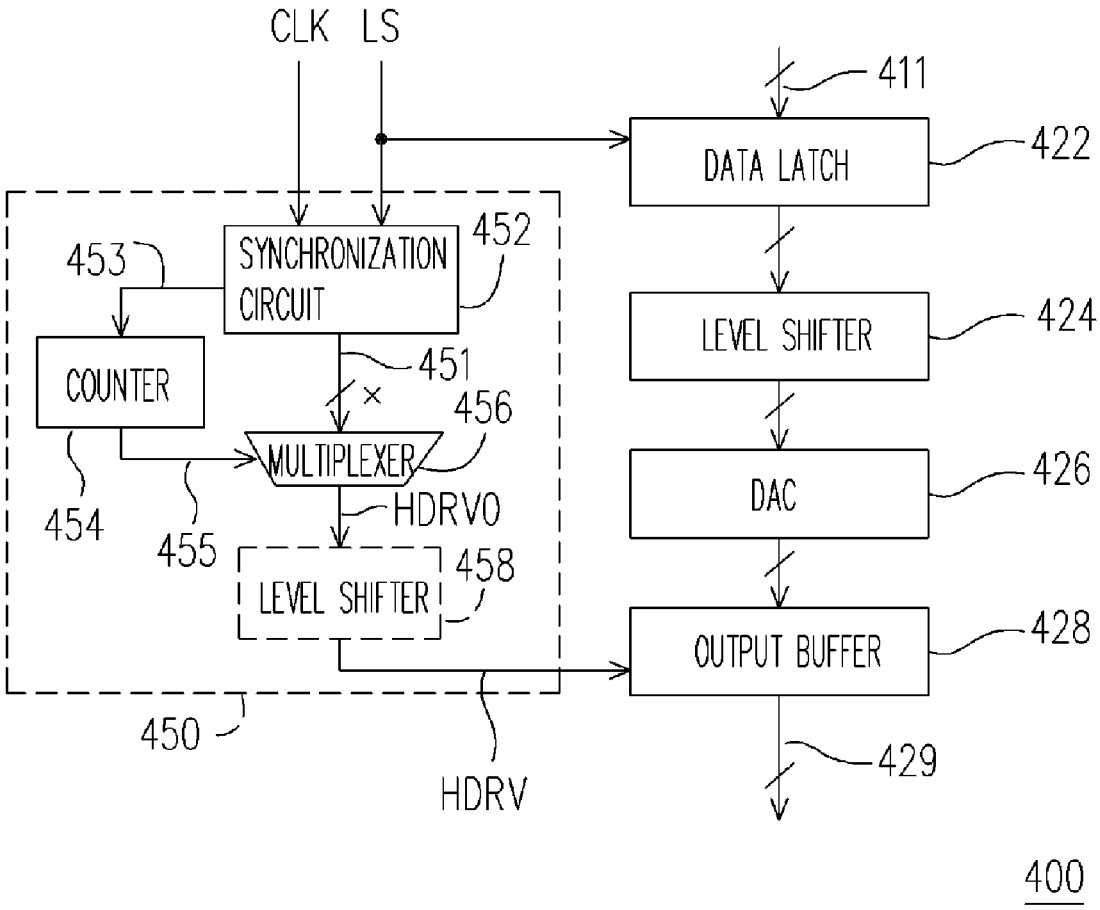
FIG. 4A is a schematic block diagram showing a soft-start high driving device according to another embodiment of the present invention.

The soft-start high driving mechanism is not only achieved in the above condition that the internal bias current of the output buffer is adjusted with a fixed preset high-driving time. In addition, in an alternative method, the preset high-driving time is adjusted with a fixed internal bias current of the output buffer. FIG. 4A is a schematic block diagram showing a soft-start high driving device according to another embodiment of the present invention. Referring to FIG. 4A, a source driver 400, similar to the source driver 120 in FIG. 1A, includes a data-latching device 422, a level shifter 424, a digital-to-analog converter (DAC) 426, an output buffer 428 and a high-driving control unit 450. Wherein, the high-driving control unit 450 includes a synchronization circuit 452, a counter 454, a multiplexer 456 and a level shifter 458.

Figure 4B:
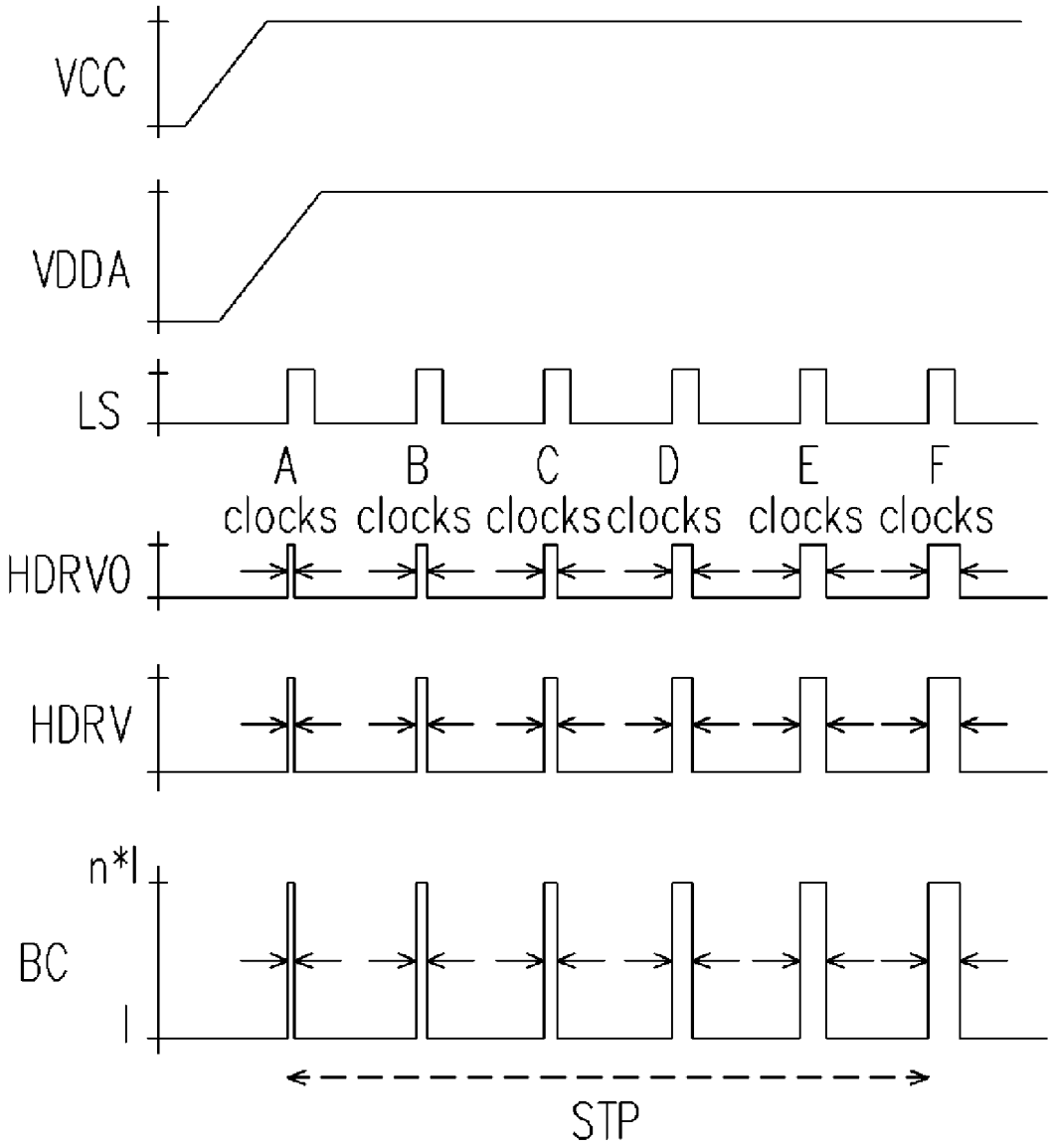
FIG. 4B is a schematic timing chart of the signals in FIG. 4A when the power voltage returns to a normal level.

FIG. 4B is a schematic timing chart of the signals in FIG. 4A when the power voltage returns from a low level to a normal level (for example, turning-on or resuming from a standby status). Referring to FIGS. 4A and 4B, the data-latching device 422 receives a display data 411 output from a timing controller (not shown) and latches the display data according to the timing of a latching signal LS. The synchronization circuit 452 receives the latching signal LS and a clock signal CLK and outputs a counting signal 453 and x pieces of internal control signals 451 with various pulse widths. For example, the synchronization circuit 452 counts the clock signal CLK and outputs A pieces of clock pulse widths, B pieces of clock pulse widths, C pieces of clock pulse widths, D pieces of clock pulse widths, E pieces of clock pulse widths and F pieces of clock pulse widths respectively, six internal control signals in total. As the power voltage is restored from a low level to a normal level during a soft-start adjusting period STP, the synchronization circuit 452 takes the clock signal CLK to latch the latching signal LS output from the data-latching device, and produces internal control signals with various pulse widths. Anyone skilled in the art is able to take advantage of a RC charge-discharge circuit (resistance-capacitance circuit) or other electronic layouts to control the preset high-driving time controlled by the synchronization circuit 452.

The counting signal 453 can be a latching signal LS. The counter 454 takes the counting signal 453 as the clock signal thereof and counts it, and outputs a counting result 455. The multiplexer 456 selects one of the internal control signals 451 according to the counting result 455 and takes the counting result 455 as a high-driving control signal HDRV0 for output. The level shifter 458 converts the level of the high-driving control signal HDRV0 into a level acceptable by the output buffer 428 and outputs a high-driving control signal HDRV. Anyone skilled in the art is able to match the output level of the synchronization circuit 452 with the output buffer 428. Thus, the level shifter 458 can be spared.

According to the received high-driving control signal HDRV, the output buffer 428 increases the bias current BC of the internal operational amplifier from an original current I to n*I during the preset high-driving time. In this way, the driving capacity of the output signal 429 from the buffer is changed. Once the time for increasing the driving capacity of the display signal 429 reaches the preset high-driving time, the synchronization circuit 452 pulls all the internal signals 451 to a low level. In other words, the high-driving control signal HDRV is pulled down to a low level, so that the bias current BC of the operational amplifier inside the output buffer 428 is restored to the original current I. Consequently, the driving capacity of the display signal 429 returns to the original amount by controlling the output buffer 428.

The original current of the bias current BC of the operational amplifier inside the output buffer is I. During the soft-start adjusting period STP, the multiplexer 456 successively takes the internal control signals 451 with various clock pulse widths from small amount to large amount to output. In the embodiment, the soft-start adjusting period STP is set, for example, in six stages. The multiplexer 456 successively takes A pieces of clock pulse widths, B pieces of clock pulse widths, C pieces of clock pulse widths, D pieces of clock pulse widths, E pieces of clock pulse widths and F pieces of clock pulse widths respectively, six internal control signals in total, and outputs them as the high-driving control signal HDRV0 (as shown in FIG. 4B). Anyone skilled in the art, however, is able to specify other stage number to meet the requirement. In addition, the method to adjust the preset high-driving pulse width is not limited to the above-described gradually increasing manner, as shown in FIG. 4B. Anyone skilled in the art is able to take a gradually decreasing manner or other soft-start manner to adjust the preset high-driving pulse width depending on various predetermined events (for example, turning-on, turning-off, an abnormal clock signal, an abnormal control signal, insufficient power, and excessive power). For example, during a soft-start adjusting period STP, the preset high-driving time is gradually increased from a minimum high-driving time to a maximum high-driving time. Alternatively, during a soft-start adjusting period STP, the preset high-driving time is gradually decreased from a maximum preset time to a minimum high-driving time.

Anyone skilled in the art is able to combine the above-described two embodiments into a new mechanism. That is, while the bias current inside the output buffer is gradually adjusted, the preset high-driving time length is also gradually adjusted to perform high-driving with soft-start adjustments.

As a predetermined event happens (including one of turning-on, turning-off, an abnormal clock signal, an abnormal control signal, insufficient power, and excessive power), the following conditions may occur. The clock signal stops transition, the latching signal has a transition time shorter than the minimum latching period or longer than maximum latching period, and even the latching signal stops transition. All these abnormal conditions would lead to erroneous actions of the above-described high-driving mode and a surging current. In the following, two other embodiments are provided to avoid the erroneous actions of the high-driving mode.

Figure 5A:
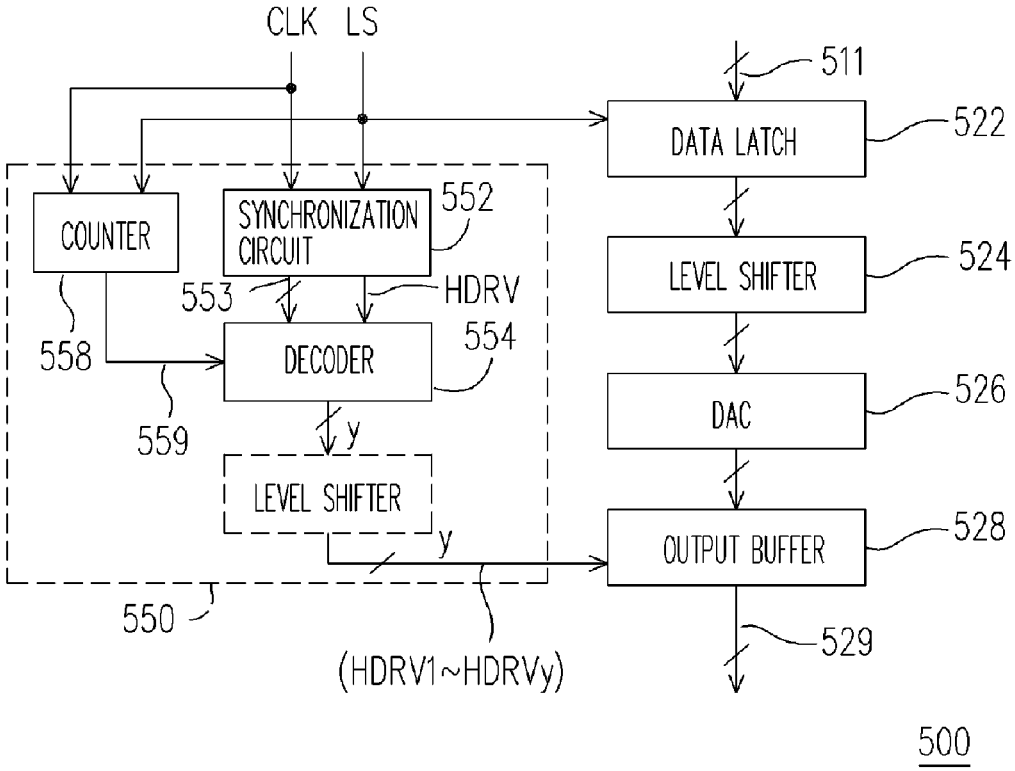
FIG. 5A is a schematic block diagram showing a soft-start high driving device according to yet another embodiment of the present invention.

FIG. 5A is a schematic block diagram showing a soft-start high driving device according to yet another embodiment of the present invention. Referring to FIG. 5A, a source driver 500, similar to the source driver 300 in FIG. 3A, includes a data-latching device 522, a level shifter 524, a digital-to-analog converter (DAC) 526, an output buffer 528 and a high-driving control unit 550. In comparison with the source driver 300, the high-driving control unit 550 in the source driver 500 further includes a counter 558.

Figure 5B:
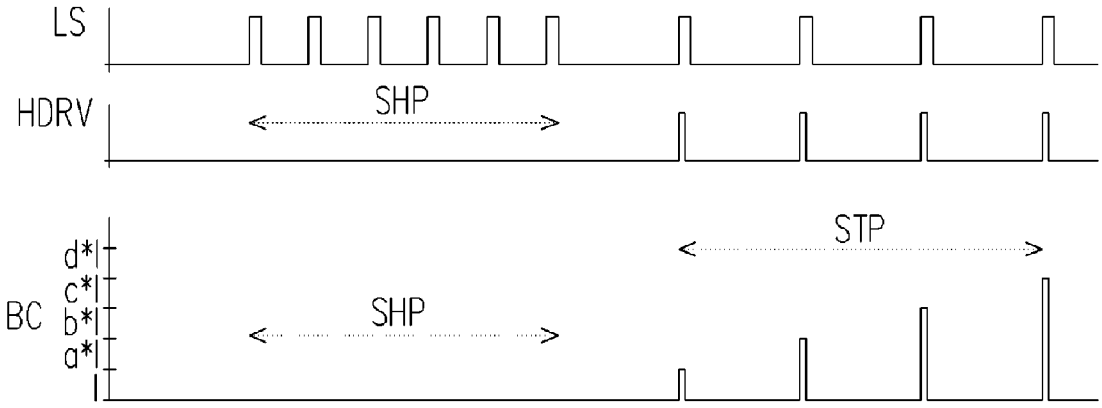
FIG. 5B is a schematic timing chart of the signals in FIG. 5A when a predetermined event happens.

FIG. 5B is a schematic timing chart of the signals in FIG. 5A when a predetermined event happens. Referring to FIG. 5A and 5B, the data-latching device 522 receives a display data 511 output from a timing controller (not shown) and latches the display data according to the timing of a latching signal LS. The synchronization circuit 552 receives the latching signal LS and a clock signal CLK, and outputs an internal control signal 553 and a high-driving control signal HDRV. If a predetermined event happens, during an initial happening period SHP of the event as shown in FIG. 5B, the counter 558 disables a decoder 554 through an enabling signal 559. As a result, the high-driving is on pause during the initial happening period SHP of the event. The cycle number of the latching signal LS counted by the counter 558 decides whether the initial happening period SHP of the event should end or not. In FIG. 5B, for example, once six cycles of the latching signal LS are counted out, the enabling signal 559 enables the decoder 554. After ending the initial happening period SHP of the event, the system enters the soft-start adjusting period STP and runs the same soft-start high driving mechanism as the described in the embodiment hereinabove.

In addition, the counter 558 is also able to count the clock signal CLK for deciding whether the decoder 554 is enabled through the enabling signal 559 or not, so as to avoid an erroneous action of the high-driving mode due to suspended transition of the clock signal CLK. On the other hand, the counter 558 is able to count the cycle numbers of the present latching signal LS through the clock signal CLK, according to which it is decided whether the decoder 554 is enabled through the enabling signal 559 or not. In this way, an erroneous action of the high-driving mode caused by such conditions as a time-interval of the latching signal transition is shorter than the minimum latching period, or longer than the maximum latching period or even caused by suspended transition of the latching signal can be avoided.

Figure 6A:
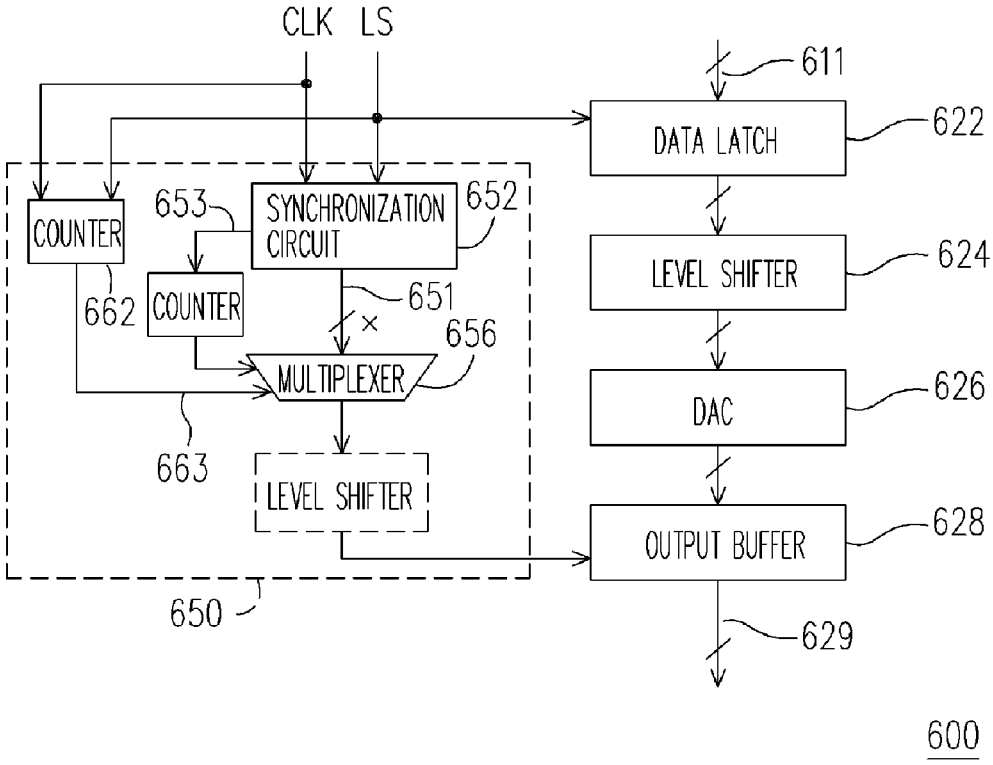
FIG. 6A is a schematic block diagram showing a soft-start high driving device according to still another embodiment of the present invention.

FIG. 6A is a schematic block diagram showing a soft-start high driving device according to still another embodiment of the present invention. Referring to FIG. 6A, a source driver 600, similar to the source driver 400 in FIG. 4A, includes a data-latching device 622, a level shifter 624, a digital-to-analog converter (DAC) 626, an output buffer 628 and a high-driving control unit 650. In comparison with the source driver 400, the high-driving control unit 650 in the source driver 600 further includes a counter 662.

Figure 6B:
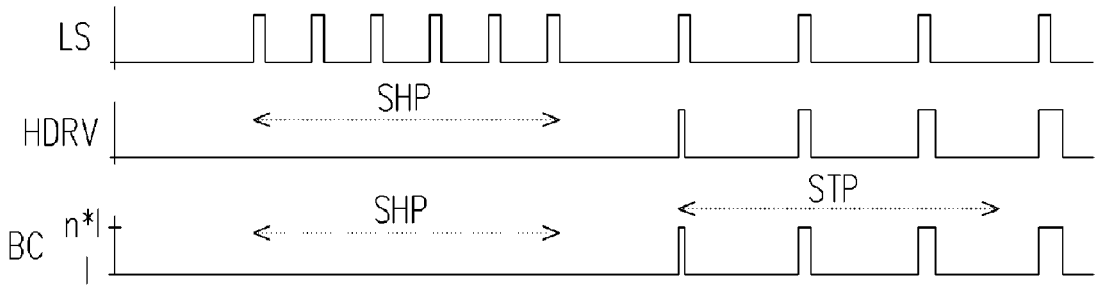
FIG. 6B is a schematic timing chart of the signals in FIG. 6A when a predetermined event happens.

FIG. 6B is a schematic timing chart of the signals in FIG. 6A when a predetermined event happens. Referring to FIGS. 6A and 6B, the data-latching device 622 receives a display data 611 output from a timing controller (not shown) and latches the display data according to the timing of a latching signal LS. The synchronization circuit 652 receives the latching signal LS and a clock signal CLK, and outputs a counting signal 653 and x pieces of internal control signals 651 with various pulse widths. If a predetermined event happens, during an initial happening period SHP of the event as shown in FIG. 6B, the counter 662 disables a multiplexer 656 through an enabling signal 663. As a result, the high-driving is on pause during the initial happening period SHP of the event. The cycle number of the latching signal LS counted by the counter 662 determines whether the initial happening period SHP of the event should end or not. In FIG. 6B, for example, once six cycles of the latching signal LS are counted out, the enabling signal 663 enables the multiplexer 656. After ending the initial happening period SHP of the event, the system enters the soft-start adjusting period STP and runs the soft-start high-driving mode adjustments as described in the embodiment hereinabove.

The counter 662 is also able to count the clock signal CLK for deciding whether the multiplexer 656 is enabled through the enabling signal 663 or not, so as to avoid an erroneous action of the high-driving mode due to suspended transition of the clock signal CLK. On the other hand, the counter 662 is able to count the cycle numbers of the present latching signal LS through the clock signal CLK, according to which it is decided whether the multiplexer 656 is enabled through the enabling signal 663 or not. In this way, an erroneous action of the high-driving mode caused by such conditions as a time-interval of the latching signal transition is shorter than the minimum latching period, or longer than the maximum latching period, or even caused by suspended transition of the latching signal can be avoided.

Accordingly, in the high-driving mode for driving a display panel of the present invention, at transitions of a display signal, the driving capacity thereof is advanced, then the driving capacity is pulled down to an original amount. Therefore, the present invention is able to effectively reduce power consumption and maintain, even shorten the output settling time. Meanwhile, by means of a soft-start high-driving mode in the present invention, a surging current caused by turning on/turning off or other specific conditions can be prevented, which further makes the source driver immune to incorrect timing. In addition, the soft-start manner also reduces a potential burning risk with external system components (for example, inductors) and advances the safety and the reliability of the whole display system.

It will be apparent to those skilled in the art that various modifications and variations can be made to the structure of the present invention without departing from the scope or spirit of the invention. In view of the foregoing, it is intended that the specification and examples to be considered as exemplary only, with a true scope and spirit of the invention being indicated by the following claims and their equivalents.

What is claimed is:

1. A soft-start high driving method used for driving a display panel, comprising:

providing a display signal used for driving the display panel and displaying images;

taking a high-driving mode for dynamically adjusting the driving capacity of the display signal if no predetermined event happens, wherein the steps of the high-driving mode for dynamically adjusting the driving capacity of the display signal comprise:

increasing the driving capacity of the display signal to a preset high-driving amount as the display signal switches status; and pulling down the driving capacity of the display signal to an original amount as the time for a display signal to increase the driving capacity thereof reaches the preset high-driving time; and taking a soft-start high-driving mode to gradually increase or decrease the driving capacity of the display signal in multiple stages by respectively gradually increasing or decreasing a bias current of an output buffer or a preset high-driving time if a predetermined event happens, wherein the steps of performing the soft-start high-driving mode comprise gradually increasing the preset high-driving time from a minimum high-driving time to a maximum high-driving time during a soft-start adjustment period or gradually decreasing the preset high-driving time from a maximum high-driving time to a minimum high-driving time during a soft-start adjustment period.

2. The soft-start high driving method as recited in claim 1, wherein the predetermined event comprises an abnormal clock signal, and the abnormal clock signal comprises suspended transition of a clock signal.

3. The soft-start high driving method as recited in claim 1, wherein the predetermined event comprises an abnormal control signal, and the abnormal control signal comprises a condition that the time-interval of transition of a latching signal is shorter than a minimum latching period.

4. The soft-start high driving method as recited in claim 1, wherein the predetermined event comprises an abnormal control signal, and the abnormal control signal comprises a condition that the time-interval of transition of a latching signal is longer than a maximum latching period.

5. The soft-start high driving method as recited in claim 1, wherein the predetermined event comprises an abnormal control signal, and the abnormal control signal comprises a condition that a latching signal stops transitions.

6. The soft-start high driving method as recited in claim 1, wherein the preset high-driving time is measured by counting a clock signal.

7. The soft-start high driving method as recited in claim 1, wherein the preset high-driving amount and the preset high-driving time in the steps to increase/pull down the driving capacity of the display signal are decided by a high-driving control signal.

8. The soft-start high driving method as recited in claim 1, wherein the steps of performing the soft-start high-driving mode further comprise setting the preset high-driving time at zero during an initial happening period of one of the predetermined events.

9. The soft-start high driving method as recited in claim 1, wherein the display panel comprises a liquid crystal display (LCD) panel.

10. The soft-start high driving method as recited in claim 1, wherein the predetermined event comprises one of turning-on, turning-off, an abnormal clock signal, an abnormal control signal, insufficient electric power, or excessive electric power.

11. A soft-start high driving device for driving a display panel, the driving device comprising:

a timing controller used for outputting a latching signal and a display data according to a clock signal; and a source driver comprising an output buffer, and the source driver coupled to the timing controller and the display panel for receiving the latching signal and the display data and outputting a display signal to the display panel, wherein, if no predetermined event happens, a high-driving mode is used for dynamically adjusting the driving capacity of a display signal; if a predetermined event happens, a soft-start high-driving mode is configured to gradually increase or decrease the driving capacity of the display signal in multiple stages by respectively gradually increasing or decreasing a bias current of the output buffer or a preset high-driving time, wherein the source driver further comprises:

a data-latching device used for latching and outputting the display data according to the latching signal;

a digital-to-analog converter (DAC) used for converting the display data output from the data-latching device into the display signal, wherein the output buffer is coupled to the DAC for dynamically adjusting the driving capacity of the display signal according to a high-driving control signal and outputting the display signal to the display panel; and a high-driving control unit used for outputting the high-driving control signal for controlling the output buffer as the display signal switches status, to increase the driving capacity of the display signal to a preset high-driving amount, and, once the time for increasing the driving capacity of the display signal reaches the preset high-driving time, controlling the output buffer to make the driving capacity of the display signal decline to an original amount, wherein the high-driving control unit controls the output buffer through a high-driving control signal for increasing the preset high-driving time from a minimum high-driving time to a maximum high-driving time during a soft-start adjustment period or for decreasing the preset high-driving time from a maximum high-driving time to a minimum high-driving time during a soft-start adjustment period.

12. The soft-start high driving device as recited in claim 11, wherein the predetermined event comprises an abnormal clock signal, and the abnormal clock signal comprises suspended transition of a clock signal.

13. The soft-start high driving device as recited in claim 11, wherein the predetermined event comprises an abnormal control signal, and the abnormal control signal comprises a condition that the time-interval of transition of a latching signal is shorter than a minimum latching period.

14. The soft-start high driving device as recited in claim 11, wherein the predetermined event comprises an abnormal control signal, and the abnormal control signal comprises a condition that the time-interval of transition of a latching signal is longer than a maximum latching period.

15. The soft-start high driving device as recited in claim 11, wherein the predetermined event comprises an abnormal control signal, and the abnormal control signal comprises a condition that a latching signal stops transitions.

16. The soft-start high driving device as recited in claim 11, wherein the high-driving control unit further counts the clock signal for deciding whether the preset high-driving time is reached or not.

17. The soft-start high driving device as recited in claim 11, wherein the output buffer decides the preset high-driving amount and the preset high-driving time according to the high-driving control signal.

18. The soft-start high driving device as recited in claim 11, wherein the high-driving control unit controls the output buffer through the high-driving control signal for setting the preset high-driving time at zero during a soft-start adjustment period.

19. The soft-start high driving device as recited in claim 11, wherein the high-driving control unit further comprises:

a synchronization circuit used for receiving the latching signal and the clock signal and outputting a counting signal and a plurality of internal control signals with various pulse widths;

a first counter coupled to the synchronization circuit for counting the counting signal and then outputting a counting result; and a multiplexer coupled to the synchronization circuit and the first counter for selecting one of the internal control signals according to the counting result and outputting the high-driving control signal.

20. The soft-start high driving device as recited in claim 19, wherein the high-driving control unit further comprises:

a second counter coupled to the multiplexer for counting the clock signal following the timing of the latching signal and accordingly outputting an enabling signal;

wherein the multiplexer further decides whether to output the high-driving control signal or not according to the enabling signal.

21. The soft-start high driving device as recited in claim 11, wherein the display panel comprises a liquid crystal display (LCD) panel.

22. The soft-start high driving device as recited in claim 11, wherein the predetermined event comprises one of turning-on, turning-off, an abnormal clock signal, an abnormal control signal, insufficient electric power, or excessive electric power.

* * * * *